US008845368B1

(12) United States Patent
Gardner

(10) Patent No.: US 8,845,368 B1
(45) Date of Patent: Sep. 30, 2014

(54) ELECTRICAL CONNECTORS

(75) Inventor: Brock R. Gardner, Seattle, WA (US)

(73) Assignee: Amazon Technologies, Inc., Reno, NV (US)

( * ) Notice: Subject to any disclaimer, the term of this patent is extended or adjusted under 35 U.S.C. 154(b) by 229 days.

(21) Appl. No.: 13/601,914

(22) Filed: Aug. 31, 2012

(51) Int. Cl.
*H01R 13/64* (2006.01)

(52) U.S. Cl.
USPC ..... 439/680

(58) Field of Classification Search
CPC .. H01R 13/64; H01R 13/6456; H01R 13/645; H01R 13/642; H01R 23/7073
USPC ..... 439/680, 681, 626, 660
See application file for complete search history.

(56) References Cited

U.S. PATENT DOCUMENTS

| | | | | | |
|---|---|---|---|---|---|
| 1,954,375 | A | * | 4/1934 | Blinn | 439/95 |
| 2,170,285 | A | * | 8/1939 | Fisher et al. | 439/122 |
| 2,297,188 | A | * | 9/1942 | Joyce | 307/149 |
| 3,059,214 | A | * | 10/1962 | Heller | 439/336 |
| 3,086,188 | A | * | 4/1963 | Ross | 439/291 |
| 3,129,993 | A | * | 4/1964 | Ross | 439/294 |
| 3,287,031 | A | * | 11/1966 | Simmons et al. | 285/27 |
| 3,626,354 | A | * | 12/1971 | Banner | 439/105 |
| 3,634,811 | A | * | 1/1972 | Teagno et al. | 439/290 |
| 3,874,761 | A | * | 4/1975 | Stauffer | 439/279 |
| 3,905,668 | A | * | 9/1975 | Gee | 439/587 |
| 4,239,319 | A | * | 12/1980 | Gladd et al. | 439/620.21 |
| 4,790,763 | A | * | 12/1988 | Weber et al. | 439/65 |
| 4,990,099 | A | * | 2/1991 | Marin et al. | 439/284 |
| 5,380,216 | A | * | 1/1995 | Broeksteeg et al. | 439/352 |
| 5,487,677 | A | * | 1/1996 | Hoffner | 439/293 |
| 5,634,816 | A | * | 6/1997 | Ohtaka et al. | 439/546 |
| 5,890,922 | A | * | 4/1999 | Buchter et al. | 439/284 |
| 6,165,013 | A | * | 12/2000 | Broussard | 439/606 |
| 6,302,745 | B1 | * | 10/2001 | Landis et al. | 439/681 |
| 6,390,432 | B1 | * | 5/2002 | VanderHeide et al. | 248/346.01 |
| 6,394,856 | B1 | * | 5/2002 | Wertz | 439/681 |
| 6,400,559 | B1 | * | 6/2002 | Kohler et al. | 361/648 |
| 6,832,929 | B2 | * | 12/2004 | Garrett et al. | 439/378 |
| 6,953,370 | B2 | * | 10/2005 | Matsuoka et al. | 439/680 |
| 6,974,351 | B1 | * | 12/2005 | Lauk et al. | 439/651 |
| 7,179,130 | B2 | * | 2/2007 | Judge et al. | 439/638 |
| D550,627 | S | * | 9/2007 | Su et al. | D13/147 |
| 7,726,993 | B2 | * | 6/2010 | Simeon et al. | 439/195 |
| 7,731,520 | B1 | * | 6/2010 | Daily et al. | 439/357 |
| 7,914,347 | B2 | * | 3/2011 | Paulus | 439/680 |
| 8,025,527 | B1 | * | 9/2011 | Draggie et al. | 439/535 |
| 8,025,536 | B1 | * | 9/2011 | Kelly | 439/681 |
| 8,070,533 | B1 | * | 12/2011 | Tai et al. | 439/681 |
| 8,197,265 | B1 | * | 6/2012 | Lee et al. | 439/105 |
| 8,287,284 | B1 | * | 10/2012 | Nishizawa | 439/13 |
| 8,337,254 | B2 | * | 12/2012 | Jin | 439/675 |
| 8,348,682 | B1 | * | 1/2013 | Draggie et al. | 439/107 |
| 8,616,900 | B1 | * | 12/2013 | Lion | 439/76.1 |
| 8,687,356 | B2 | * | 4/2014 | Merrow | 361/679.47 |
| 2004/0209513 | A1 | * | 10/2004 | Reid | 439/502 |
| 2007/0298642 | A1 | * | 12/2007 | Kameyama et al. | 439/275 |
| 2009/0006701 | A1 | * | 1/2009 | Novotney et al. | 710/304 |
| 2011/0097915 | A1 | * | 4/2011 | Ruffner | 439/174 |

* cited by examiner

*Primary Examiner* — Amy Cohen Johnson
*Assistant Examiner* — Vladimir Imas
(74) *Attorney, Agent, or Firm* — Kilpatrick Townsend & Stockton LLP

(57) ABSTRACT

An electrical connector. The connector includes rails that attach to channels. The rails and the channels can be fully supported along their length to prevent damage. In addition, a nonconductive mass of the connector is positioned between the rails and the channels, preventing an accidental short.

27 Claims, 5 Drawing Sheets

ELECTRICAL CONNECTORS

BACKGROUND

Power connections are typically made by AC power plugs that connect to appropriate receptacles. There are two basic classifications of plugs: straight-blade and locking. Both of these designs include exposed blades that fit into appropriate slots in a wall or cable receptacle. Straight-blade plugs are found nearly everywhere, and are intended for supplying light-duty, general purpose electrical devices with power. Twist-locking plug types are used for heavy industrial and commercial equipment, where increased protection against accidental disconnection is desired.

A drawback to conventional power plugs is that the blades of the straight-blade and locking plugs are fully exposed, and failures occur by arching across these exposed blades. In addition, the exposed blades can be damaged if not inserted correctly.

BRIEF DESCRIPTION OF THE DRAWINGS

Various embodiments in accordance with the present disclosure will be described with reference to the drawings, in which.

DETAILED DESCRIPTION

Figure 1:
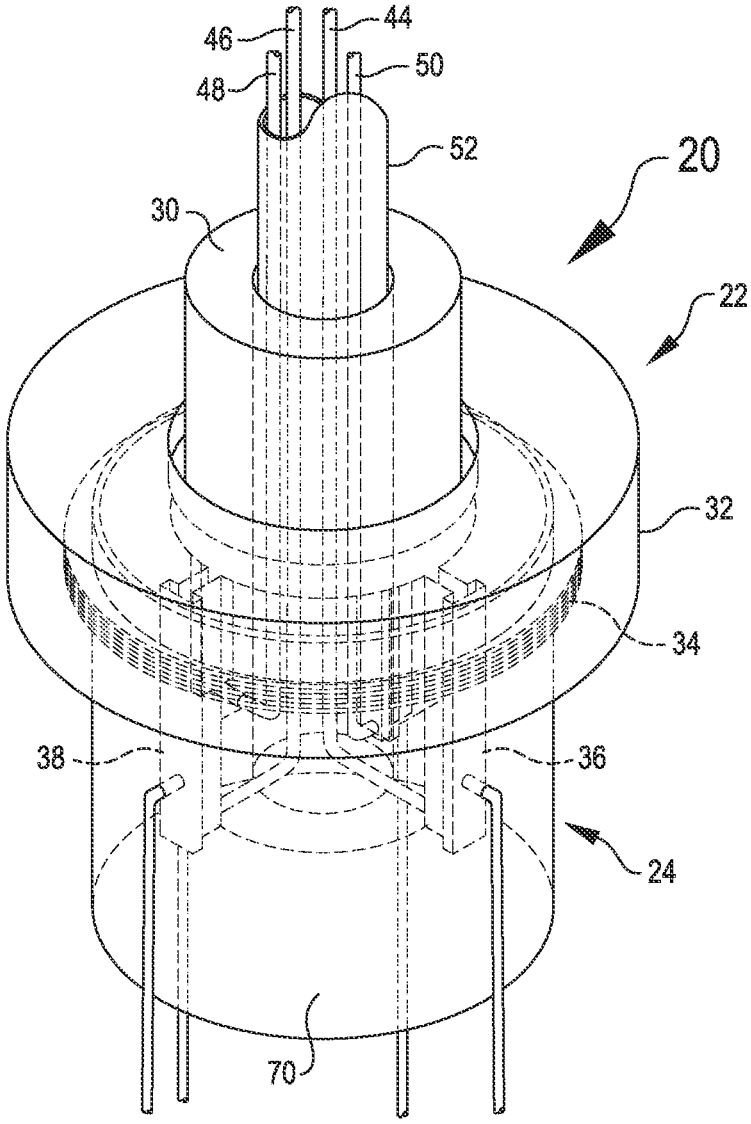
FIG. 1 is a perspective view of a power connector in accordance with embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In accordance with embodiments, electrical power connectors are provided having rails mounted and supported on the exterior surface of a socket. For power connection, the socket attaches to a receptor, which in turn includes channels for receiving the rails. The rails may be, for example, elongate t-shaped beams. The rails fit in to receptor channels on the receptor, which may be u-shaped or otherwise appropriately shaped to receive the t-shaped beams. The rails and receptors provide a larger contact area than the blade and slot arrangement in a traditional electrical plug.

In embodiments, a plug is designed with a plurality of the rails and/or receptor channels about the periphery of an insulated block. Wires are attached to these rails and/or receptor channels and extend into the insulated block and lead into a cable. The insulated block provides an insulated mass separating each of the rails of the plug. This structure is in contrast to prior art plugs, which include exposed blades that are subject to shorting or can be bent if inserted improperly in a receptacle.

A receptor for the power connector includes a corresponding number of rails and/or receptor channels for connecting to the receptor channels and/or rails on the socket. The receptor may take the form, for example, of a tube. In such an embodiment, the rails and/or receptor channels on the receptor are positioned on the inside of the tubular structure. Wires for the receptor tube may extend along the outside of the receptor tube and connect to the appropriate rails and/or channels.

When inserted, the rails of the socket extend into corresponding channels on the receptor tube, and receptor tubes on the socket extend over and capture rails on the receptor tube. In embodiments, a single receptor channel may be used on the socket, with three rails, corresponding to positive, negative, and neutral. In this embodiment, a corresponding three receptor channels are included on the receptor tube for receiving the three rails. A single rail is positioned within the receptor tube for fitting into the single receptor channel on the socket. This structure permits proper alignment of positive, negative, neutral and ground connectors. Use of an asymmetrical pattern assures that all connections are made with the appropriate rail or channel.

Rails may connect to receptor channels by friction fit, tapering, flexible metal connections, or any other appropriate connection that allows an electrical connection of the two components. The rails and the receptor tubes can be of various lengths, for example, two to six inches long, and provide a larger contact area than the blades of traditional electrical plugs.

As set forth above, the structure positioned between the rails and receptor channels of the socket provides an insulated mass between the connectors, helping to prevent arcing between the connectors. Similarly, for the receptor tube, the connectors are spaced around an insulated structure. This structure isolates the connectors, preventing electrical failure.

The wires for the receptor and the socket can be isolated from each other by running wires for the receptor on the outside of the receptor tube, and wires for the socket through the inside of the insulated structure for the socket. This feature aids in limiting potential failures for the socket or receptor.

The rail and receptor connectors may be structured so that they lock in place, for example by a click lock, as pushed together. Alternatively, the socket may be inserted in the receptor tube and may be locked in place by a separate locking connection, such as a threaded locking ring.

Embodiments are directed to a socket having a nonconductive structure defining an outer perimeter and an insertion axis. The insertion axis is the direction that the socket inserts into the receptor. At least one conductive rail is mounted on the outer perimeter of the nonconductive structure and extends substantially parallel with the insertion axis. At least one conductive channel is mounted on the outer perimeter of the nonconductive structure and extends substantially parallel with the insertion axis. A receptor is provided for connecting to the socket. The receptor includes a pocket for receiving at least a portion of the nonconductive structure when the socket is connected to the receptor. For each conductive rail on the nonconductive structure, a conductive channel extends along an inside of the pocket and aligns with and extends over the conductive rail when the receptor is connected to the socket. For each conductive channel on the nonconductive structure, a conductive rail extends along an inside of the pocket and aligns with and extends into the conductive channel on the nonconductive structure when the receptor is connected to the socket.

In accordance with additional embodiments, electrical connectors are provided for shelf-mounted hardware components, such as computing devices that are mounted on a server rack. In embodiments, hardware rails are provided for installing the hardware devices onto or into the racks or shelves in a sliding manner. A power plate is provided in the path of the hardware rails. The power plate includes a plurality of rails and/or receptor channels, similar to the connectors described for the socket above. These rails and/or receptor channels can be hardwired to power cables for the shelving structure, providing efficient wire management for the hardware components.

Hardware that is installed in the shelves or racks includes a corresponding rail and/or receptor channel structure. The rail and/or receptor channel structure may be mounted, for example, on a plate or directly on the hardware device. When mounted, the hardware device slides along hardware mounting rails for the rack or shelf until the power rails and/or receptor channels on the hardware device come in contact with the power rails/receptor channels of the power plate. The rails then connect with the corresponding receptor channels. Thus, an electrical connection is made without having to plug a separate line into the hardware. This feature provides not only the advantage of efficient wire management, but also removes wires from the rear of the device, increasing air circulation to the back of the device. Moreover, a technician does not have to access a rear of the device to plug in the power cord, speeding installation and permitting installation with limited or no rear access. Similar connection structures may be used for wiring of all types for hardware, including speaker wires, networking wires, low voltage wires and the like.

Referring now to the drawings, in which like referenced numerals represent like parts throughout the several views, FIG. 1 shows a perspective view of a power connector 20 in accordance with embodiments. The power connector 20 includes a socket 22 that connects to a receptor tube 24, as shown in the exploded perspective view of FIG. 2. The socket 22 includes a central tube 30 extending along its length. A locking sleeve 32 is mounted around the central tube 30 and includes internal threads 34 therein.

In accordance with embodiments, the central tube 30 acts as an insulating mass separating power connectors for the socket 22. Although shown as a cylindrical tube, the central tube 30 may take any shape or form, and in embodiments is any insulating structure that may be used to separate the power connectors for the socket. However, although any shape may be used, a tube is useful in that power connectors can be mounted on an exterior of the tube, and wires may be routed through the tube. The connectors may be mounted on the outside of the insulating structure to provide support for the connectors.

Figure 2:
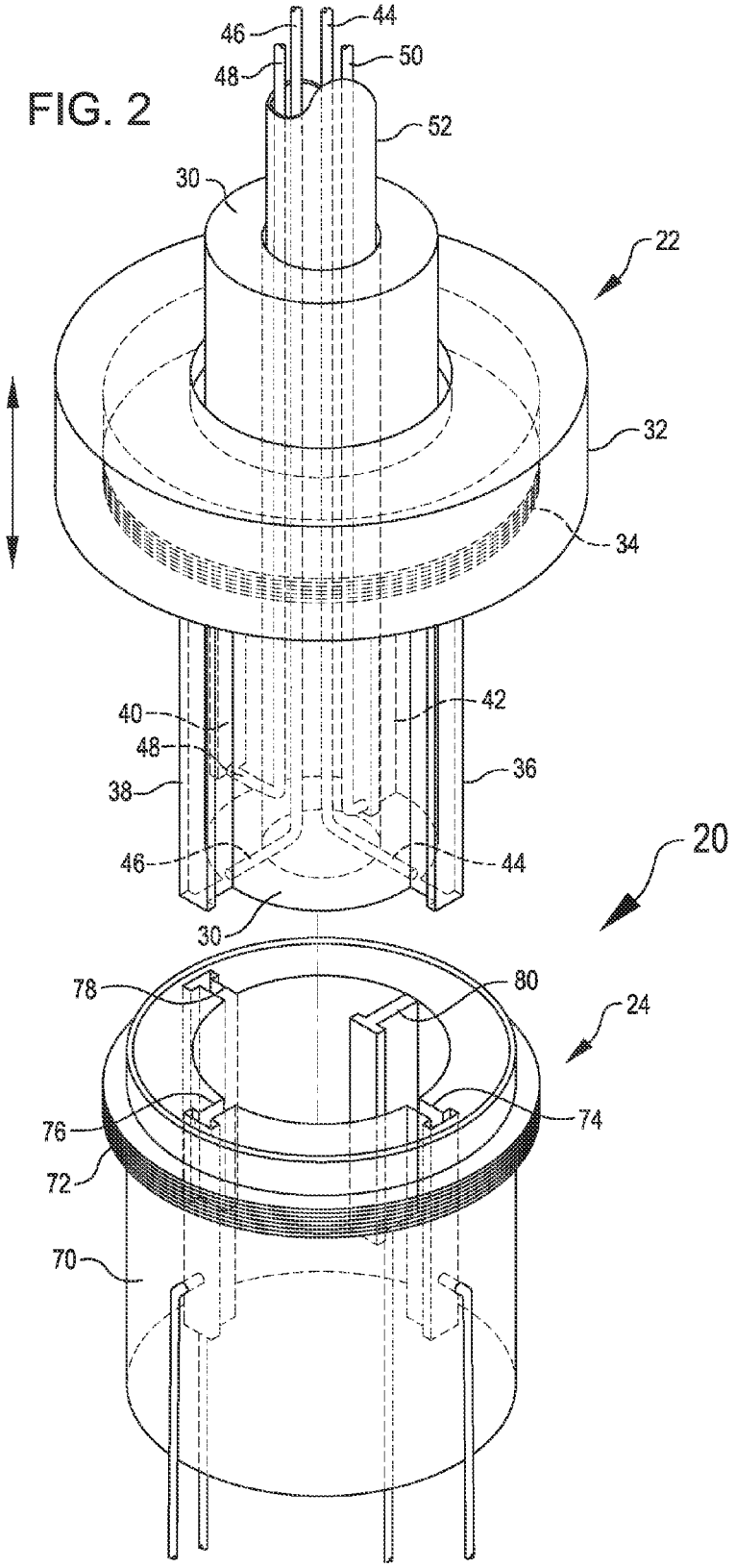
FIG. 2 is an exploded, perspective view of the power connector of FIG. 1.
Figure 3:
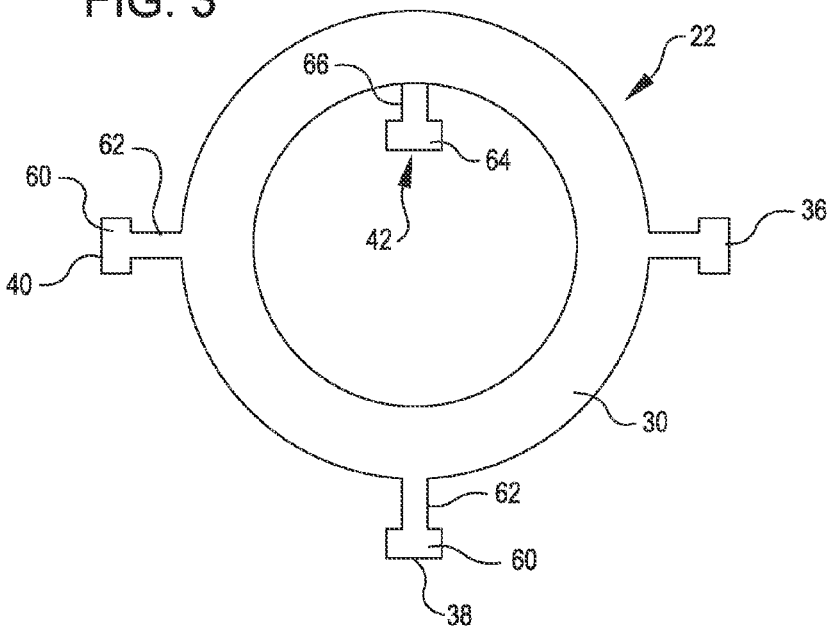
FIG. 3 is an end view of a socket for the power connector of FIGS. 1 and 2.

In accordance with embodiments, the power connectors for the socket 22 and the receptor tube 24 are formed from elongate rails and receptor channels. The receptor channels are designed to receive elongate rails, and the elongate rails are designed to fit within receptor channels. An opposed pair of a rail and a receptor channel are mounted on the socket 22 and the receptor tube 24. When installed, the rails insert into the receptor channels to provide a connection over the length of the inserted rails. The rails and receptor channels may be mounted on either the socket 22 or the receptor tube 24, and in embodiments, the rails and/or receptor channels are mounted in an asymmetrical pattern so as to assure connection of the appropriate rail with the appropriate receptor channel (e.g., positive to positive, negative to negative). In FIGS. 2 and 3, the socket 22 is shown as having three rails: a positive rail 36, a negative rail 38, and a neutral rail 40. The ground for the socket 22 is a ground channel 42. By having a single ground channel, the connectors on the socket 22 are assured of being properly aligned with the matching connectors on the receptor tube 24 when the socket is inserted within the receptor tube 24.

Wires 44, 46, 48, 50 extend from the rails 36, 38, 40 and the ground channel 42. These wires 44, 46, 48, 50 are soldered to the appropriate rail and/or channel, or are appropriate electrically connected in another manner. In an embodiment, the wires are routed on the inside of the central tube 30 and back towards a distal portion of the central tube. These wires 44, 46, 48, 50 may then be routed through a cable sheath 52, which forms a power cord for the socket. The opposite ends of the wires 44, 46, 48, 50 may be electrically connected to another suitable connector, such as an additional receptor tube 44.

The rails may take any shape, but in embodiments are elongate so as to provide a larger contact surface than the traditional blade of an electrical plug. In the embodiment shown in FIG. 3, a cross-section of the rails is t-shaped, with a top crossbar 60 and a post 62 leading from the central tube 30 to the crossbar. The t-shaped rails shown in FIG. 3 are useful in that connecting channels may be configured to fit snugly against the post 62, and the t-shaped crossbar acts as a barb to prevent accidental removal. However, as described above, different configurations and shapes of rails may be used.

As shown in FIG. 3, the channels, such as the ground channel 42, include a cross opening 64, for receiving the associated top crossbar 60 of a rail. A slot 66 opens to the top edge of the channel for receiving the post 62 of the associated rail.

Details of the receptor tube 24 are best shown in FIG. 2. In the embodiment shown in the drawing, the receptor tube 24 includes an outer casing 70, which is shaped like a tube. The outer casing 70 includes external threads 72 for receiving the internal threads 34 of the locking sleeve 32. Although shown as a tube, the receptor may take any shape. However, in embodiments, the receptor tube is preferably shaped to receive the socket 22, and thus at a minimum includes an opening, sleeve, or other structure for receiving the socket.

The outer casing 70 includes internal channels 74, 76, 78, corresponding to positive, negative and neutral for the receptor tube 24. Although shown as received within the walls of the outer casing 70, these channels may be separate structures that are spaced inside of the outer casing. In any event, in embodiments, the channels 74, 76, 78 are electrically isolated from one another via insulation, such as by forming the receptor tube of a nonconductive material. To this end, the outer casing 70 may serve as an insulator separating the connectors of the receptor tube 24.

A ground rail 80 is positioned on the inside of the outer casing 70. This ground rail 80 is positioned so that it aligns with the ground channel 42 of the socket 22 when the socket is inserted into the receptor tube 24.

In practice, the socket 22 is inserted into the receptor tube 24. The single ground rail 80 on the receptor tube is aligned with the single ground channel 42 on the socket 22. The three rails 36, 38, 40 on the socket 22 are aligned with the three channels 74, 76, 78 in the receptor tube 24. The power connectors are then pushed together so as to slide the corresponding rails and channels into connection. Once the socket 22 is pressed sufficiently into the receptor tube 24, the locking sleeve 32 may be rotated so as to connect the internal threads 34 to the external threads 72 of the outer casing of the receptor tube 24.

If desired, a front end of the socket 22 or the receptor tube 24 may be configured or arranged so as to assist in alignment and insertion of the socket 22 into the receptor tube 24. For example, a tapered or chamfered front edge may be provided on the socket 22. Likewise, the rails 36, 38, 40, 80 and/or the channels 42, 74, 76, 78 may be configured or arranged so as to aid in insertion and alignment of the rails with the channels. In addition, the channels may be tapered so that insertion is more difficult as the rails are inserted, or additional structures may be provided to aid in alignment or electrical connection between the rails and channels.

In embodiments, the rails are friction fit into the channels so as to provide an electrical connection. However, the rails and/or the channels may include flexible, outwardly or inwardly biased metal structures so as to aid in electrical connection, or may include other appropriate structures so as to aid in insertion and/or electrical connections.

The receptor tube 24 may be positioned on the end of an additional cable or mounted within a wall plate, as examples. The socket 22 and receptor tube 24 connections provide a larger contact area of electrical connection than the blades and slots in traditional electrical plugs. In addition, the structure of the socket 22 and receptor tube 24 places the mass of the structure of the electrical power connector 20 between the connectors (instead of behind them for a plug), electrically insulating the connectors from one another. For example, the central tube 30 separates and provides mounting structures for the electrical connectors on the socket 22. In addition, the insulated materials of the outer casing 70 of the receptor tube 24 electrically isolate each of the connectors for the receptor tube, providing additional safety.

In embodiments, the rail and channel structures described above may be used in configurations other than the socket and receptor tube formation described with reference to FIGS. 1-3. For example, as shown in FIGS. 4-7, a rail and channel structure may be used for electrical connection between a shelf or rack and a hardware component. In the embodiment shown in the figures, the hardware component is a computing device, such as a computer, but embodiments herein may be utilized for any hardware device requiring electrical connection and which is installed on a shelf or a rack. In addition, the structure to which the computer is attached is a rack, such as a server rack, but other structures may be used. In general, the embodiments described with respect to FIGS. 4-7 can be used for any installment where a hardware device slides into installation, for example along installation rails.

Figure 4:
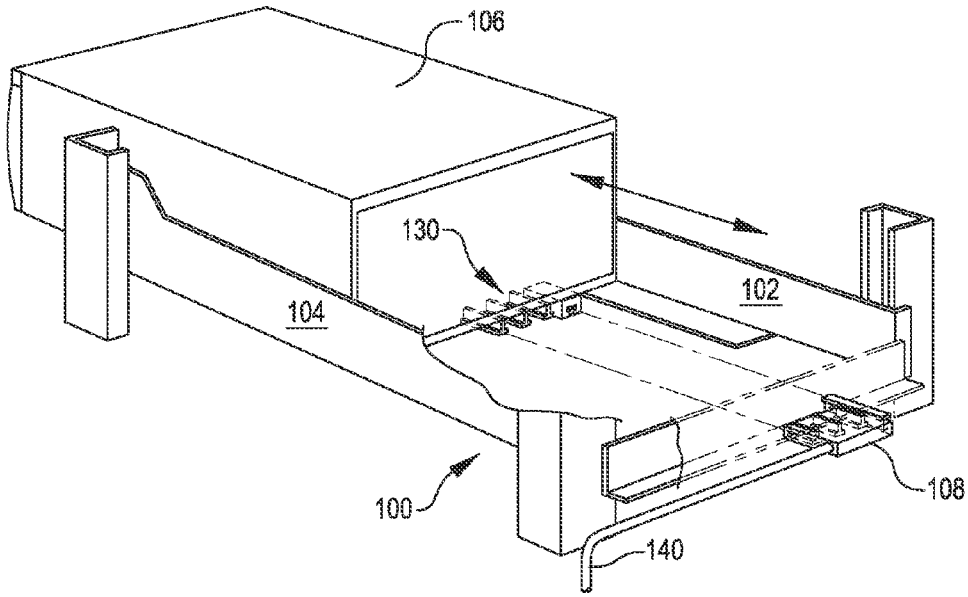
FIG. 4 is a perspective view of a computing device before insertion into a rack.
Figure 5:
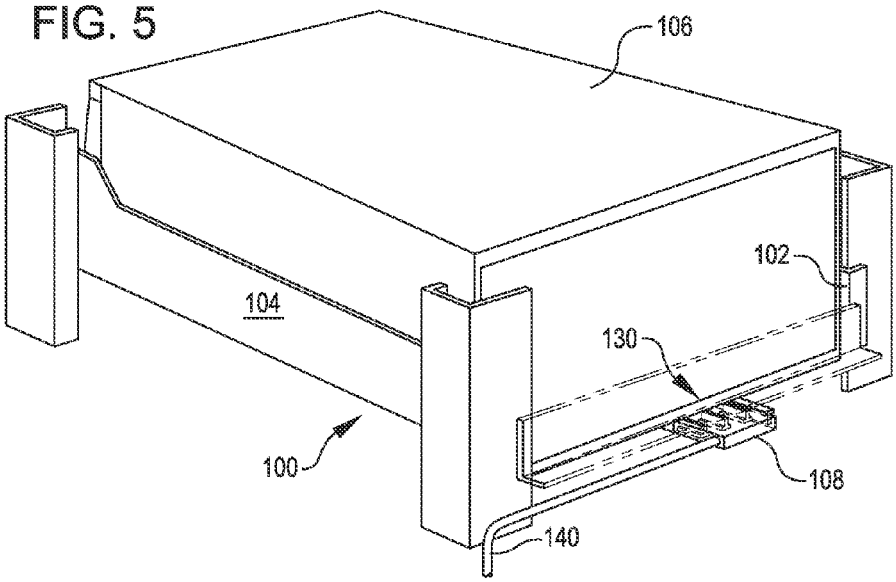
FIG. 5 is a perspective view of a computing device and rack of FIG. 4, with the computing device inserted.

Turning now to FIG. 4, a rack 100 is shown having installation rails 102, 104. The installation rails 102, 104 are standard, and are designed to receive a computing device 106, which may be, for example, a server. As is known, such rails 102, 104 are designed to receive the computing device 106, with the computing device sliding into place along the rails and then being clipped, screwed, or otherwise locked into position. The rails 102, 104 help to align the computing device 106 and insure that the computing device is properly positioned within the rack 100.

In accordance with embodiments, a rail power plate 108 is provided along the path of the computing device 106 as it moves along the server rails 102, 104. In the embodiment shown in the drawings, the rail power plate 108 is positioned at a back edge of the installation rails 102, 104, but the rail power plate 108 may be positioned at any point so that it may engage the computing device 106 when it is inserted.

Figure 6:
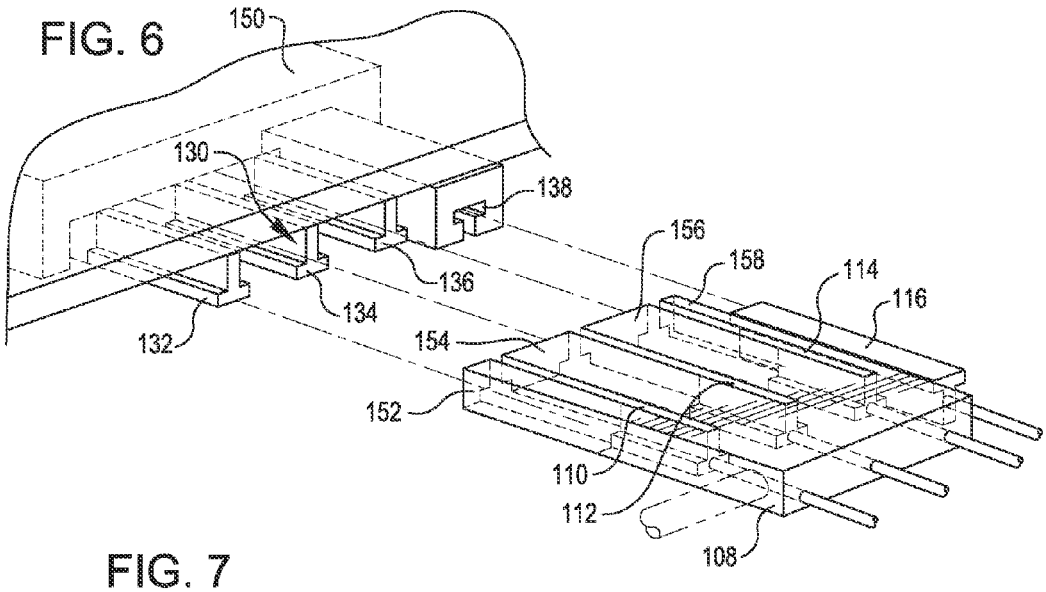
FIG. 6 is a partial cutaway perspective view of power connectors for the device and rack of FIG. 4.
Figure 7:
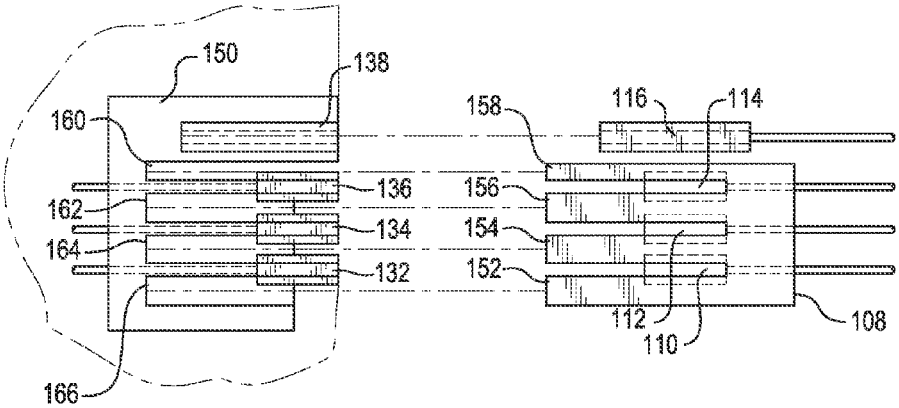
FIG. 7 is a top view of the power connectors of FIG. 6, with the connectors prior to connection.

As shown in FIGS. 6 and 7, the rail power plate 108 includes a plurality of channels 110, 112, 114 and a rail 116. In an embodiment shown in the drawings, the rail power plate 108 includes three channels 110, 112, 114, corresponding to positive, negative and neutral, and a single rail 116, corresponding to ground. However, any combination of channels and/or rails may be provided and, if desired, only channels or rails may be provided on the rail power plate 108. Preferably, in embodiments, the rail power plate is formed of an insulated material so that the channels 110, 112, 114 and the rail 116 are electrically isolated from one another.

As shown in FIG. 6, the computing device 106 includes a device power connector 130 positioned so that it will align with the rail power plate 108 when the computing device is inserted along the rails 102, 104. The device power connector 130 includes three rails 132, 134, 136 and a single channel 138 for aligning with the channels 110, 112, 114 and the rail 116 on the rail power plate 108. As shown in FIG. 7, as the computing device is inserted onto the rack 100 via the installation rails 102, 104, the rails and channels of the rail power plate 108 and the device power connector 130 align, the rails insert into the channels, and an electrical connection is provided. These rails and channels are shaped and connect similar to the rails and channels described in earlier embodiments. As with the earlier embodiments, the rails and channels may be shaped to enhance insertion and/or electrical connection or to provide a desired configuration.

The rails and channels of the device power connector 30 are hardwired into the power block or other structure in the computing device 106. The device power connector 130 may be included as part of hardware device, or may be an aftermarket installation that fits onto or is connectable to the outside of a hardware device, such as the computing device 106.

Figure 8:
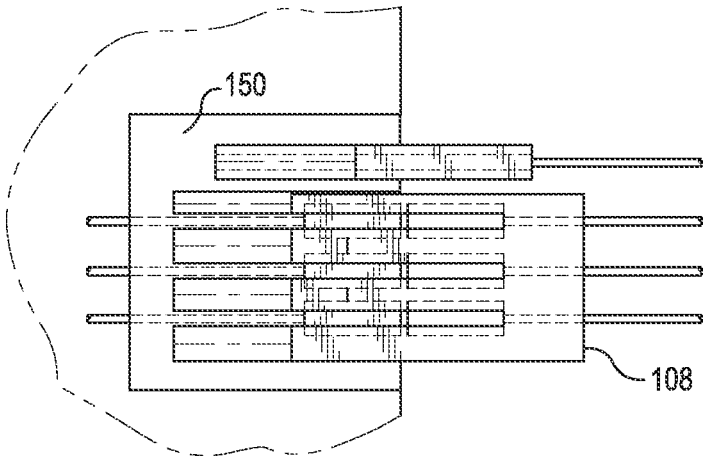
FIG. 8 is top view, similar to FIG. 7, with the connectors partially connected.
Figure 9:
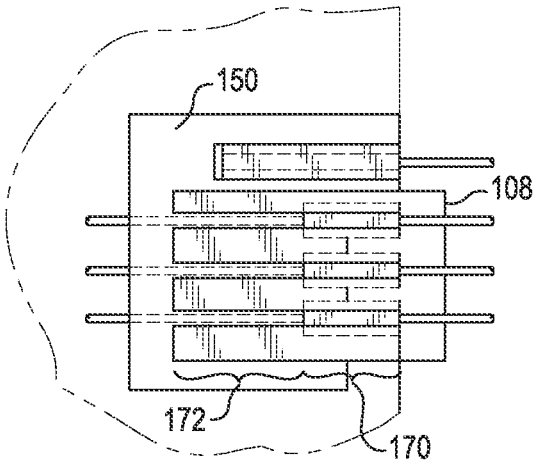
FIG. 9 is a top view, similar to FIG. 8, with the connectors fully connected and electrical connection made.

In accordance with embodiments, as best shown in FIGS. 7, 8, and 9, the rail power plate 108 may include insulated extensions 152, 154, 156, 158. These extensions 152, 154, 156, 158 fit into slots 160, 162, 164, 166 on an insulated block 150. The extensions 152, 154, 156, 158 and the slots 160, 162, 164, 166 provide a leading insertion structure that is insulated so that when the rail power plate 108 is connected to the device power connector 130, the three rails 132, 134, 136 and the single channel 138 are isolated from each other and the channels 110, 112, 114 and the rail 116 on the rail power plate 108. Thus, arcing or shorting of the rails and channels is prevented. Similar structures could be used on the previously-described embodiment.

The rail power plate 108 is connected to wires in a manner similar to the structure described above. These wires lead to a cable 140, which may be a pigtail or which may be routed within the rack 100. As such, cable management for the computing device 106 and the rack 100 is much easier, because power cables and/or other cables for the computing device 106 may be pre-routed in the rack. Moreover, these power connectors are automatically disconnected as part of moving the computing device along the server rails 102, 104 to remove the computing device. Thus, a user wishing to remove the computing device not only removes the computing device, but also disconnects electrical connections in the process. Similarly, when installing the computing device, electrical connections are made. This feature avoids unnecessary cable management and required access to the back of the computing device 106. Moreover, because the cables 104 are removed from the back of the device, airflow across the back of the device is not blocked, thus increasing the cooling effect.

As can be understood, the power plate 108 may be configured as desired so that it can be engaged by a structure on the computing device 106 when the computing device is inserted. Thus, the rail power plate 108 may be positioned above, below, to the side, or at a back end of a position where the computing device 106 is installed, or the power plate may span any combination of these positions. Additional plates, such as the rail power plate 108, may be utilized for connection of other cables, such as networking cables, speaker wires, monitor cables, or the like.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this disclosure are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications and patents, cited herein are hereby incorporated by reference to the same extent as if each reference were individually and specifically indicated to be incorporated by reference and were set forth in its entirety herein.

What is claimed is:

1. An electrical connector, comprising:

a socket comprising:

a nonconductive structure defining an outer perimeter and an insertion axis;

at least one conductive rail mounted on the outer perimeter of the nonconductive structure and extending substantially parallel with the insertion axis; and at least one conductive channel mounted on the outer perimeter of the nonconductive structure and extending substantially parallel with the insertion axis;

a receptor for connecting to the socket, the receptor comprising:

a structure defining a pocket for receiving at least a portion of the nonconductive structure when the socket is connected to the receptor;

for each conductive rail on the nonconductive structure, a conductive channel extending along an inside of the pocket and for aligning with and extending over the conductive rail when the receptor is connected to the socket; and for each conductive channel on the nonconductive structure, a conductive rail extending along an inside of the pocket and for aligning with and extending into the conductive channel on the nonconductive structure when the receptor is connected to the socket.

2. The electrical connector of claim 1, wherein said at least one conductive rail and said at least one conductive channel are each electrically connected to a wire, and wherein the wires lead to a single power cord for the socket.

3. The electrical connector of claim 2, wherein the nonconductive structure for the socket is a tube, and wherein the wires extend from said at least one conductive rail and said at least one conductive channel, into the tube, and out a back end of the tube to the power cord.

4. The electrical connector of claim 1, wherein the number of conductive rails on the socket is three, one each for positive, negative, and neutral.

5. The electrical connector of claim 4, wherein the number of conductive channels on the socket is one, corresponding to ground.

6. The electrical connector of claim 1, wherein said conductive rails have a t-shaped cross section.

7. The electrical connector of claim 1, further comprising a leading, insulated structure on at least one of the socket and the receptor so that the rails and channels are isolated from one another prior to insertion.

8. An electrical connector, comprising:

a socket comprising:

a nonconductive structure defining an outer perimeter and an insertion axis;

at least one conductive rail mounted on the outer perimeter of the nonconductive structure and extending substantially parallel with the insertion axis; and at least one conductive channel mounted on the outer perimeter of the nonconductive structure and extending substantially parallel with the insertion axis;

the nonconductive structure comprising a shape for being received in a receptor, the receptor comprising:

a structure defining a pocket for receiving at least a portion of the nonconductive structure when the socket is connected to the receptor;

for each conductive rail on the nonconductive structure, a conductive channel extending along an inside of the pocket and for aligning with and extending over the conductive rail when the receptor is connected to the socket; and for each conductive channel on the nonconductive structure, a conductive rail extending along an inside of the pocket and for aligning with and extending into the conductive channel on the nonconductive structure when the receptor is connected to the socket.

9. The electrical connector of claim 8, wherein the number of conductive rails on the socket is three, one each for positive, negative, and neutral, and wherein the number of conductive channels on the socket is one, corresponding to ground.

10. The electrical connector of claim 8, wherein said at least one conductive rail and said at least one conductive channel are each electrically connected to a wire, and wherein the wires lead to a single cord for the socket.

11. The electrical connector of claim 8, wherein the nonconductive structure for the socket is a tube, and wherein the wires extend from said at least one conductive rail and said at least one conductive channel, into the tube, and out a back end of the tube to the cord.

12. The electrical connector of claim 8, wherein said conductive rails have a t-shaped cross section.

13. The electrical connector of claim 8, wherein each of said at least one rail is supported along substantially its length by the structure.

14. The electrical connector of claim 8, wherein each of said at least one channel is supported along substantially its length by the structure.

15. The electrical connector of claim 8, further comprising a leading, insulated structure on the socket so that the rails and channels are isolated from one another prior to insertion.

16. A rack for at least one hardware device, the rack comprising:

at least one installation rail for connecting to a hardware device and for slidably installing and removing a hardware device;

an electrical connector, comprising:

a nonconductive structure defining an outer perimeter and an insertion axis, the insertion axis aligning with an insertion direction of the installation rail;

at least one conductive rail mounted on the outer perimeter of the nonconductive structure and extending substantially parallel with the insertion axis; and at least one conductive channel mounted on the outer perimeter of the nonconductive structure and extending substantially parallel with the insertion axis;

the electrical connector for being engaged by a device connector on a hardware device, the device connector comprising:

for each conductive rail on the nonconductive structure, a conductive channel for aligning with and extending over the conductive rail when the receptor is connected to the socket; and for each conductive channel on the nonconductive structure, a conductive rail for aligning with and extending into the conductive channel on the nonconductive structure when the receptor is connected to the socket.

17. The rack of claim 16, wherein the electrical connector is a power connector.

18. The rack of claim 16, wherein the number of conductive channels on the nonconductive structure is three, one each for positive, negative, and neutral.

19. The rack of claim 18, wherein the number of conductive rails on the nonconductive structure is one, corresponding to ground.

20. The rack of claim 16, wherein the electrical connector is mounted below a location where a hardware device would sit, when the hardware device is installed on the installation rails and slid to an installation position.

21. The rack of claim 16, further comprising a hardware device connected to the installation rails, and wherein the hardware device comprises the device connector.

22. The rack of claim 21, wherein the hardware device is a computing device.

23. The rack of claim 16, further comprising a leading, insulated structure on the electrical connector so that the rails and channels are isolated from one another prior to insertion.

24. A hardware device, comprising:

a device electrical connector, comprising:

a nonconductive structure defining an outer perimeter and an insertion axis, the insertion axis aligning with an insertion direction of the hardware device into a mounting structure via an installation rail;

at least one conductive rail mounted on the outer perimeter of the nonconductive structure and extending substantially parallel with the insertion axis; and at least one conductive channel mounted on the outer perimeter of the nonconductive structure and extending substantially parallel with the insertion axis;

wherein the electrical connector is configured and arranged on the hardware device for engaging and connecting with a rack electrical connector on a hardware device rack, the electrical connector comprising:

for each conductive rail on the nonconductive structure, a conductive channel for aligning with and extending over the conductive rail when the device electrical connector is connected to the rack electrical connector; and for each conductive channel on the nonconductive structure, a conductive rail for aligning with and extending into the conductive channel on the nonconductive structure when the device electrical connector is connected to the rack electrical connector.

25. The hardware device of claim 24, wherein the hardware device is a computing device.

26. The hardware device of claim 24, wherein the electrical connectors form a power connection.

27. The hardware device of claim 24, wherein the device electrical connector is mounted on a bottom surface of the hardware device.

* * * * *